US012352460B2

(12) United States Patent
Gagnon et al.

(10) Patent No.: US 12,352,460 B2
(45) Date of Patent: Jul. 8, 2025

(54) VARIABLE HEIGHT INSTALLATION MECHANISM

(71) Applicant: Broan-NuTone LLC, Hartford, WI (US)

(72) Inventors: Martin Gagnon, Drummondville (CA); Patrick Hébert, St-Cyrille de Wendover (CA); Alexandre Cloutier, Drummondville (CA); Patrick Dumas, Drummondville (CA); Daniel Bathalon, Drummondville (CA); Sébastien Dubuc, Drummondville (CA); Alexandre Gamache Veillette, Drummondville (CA); Alain Ampleman, Drummondville (CA)

(73) Assignee: Broan-NuTone LLC, Hartford, WI (US)

( * ) Notice: Subject to any disclaimer, the term of this patent is extended or adjusted under 35 U.S.C. 154(b) by 464 days.

(21) Appl. No.: 17/706,676

(22) Filed: Mar. 29, 2022

(65) Prior Publication Data

US 2022/0307722 A1 Sep. 29, 2022

Related U.S. Application Data

(60) Provisional application No. 63/167,253, filed on Mar. 29, 2021.

(51) Int. Cl.

| | |
|---|---|
| ***F24F 3/02*** | (2006.01) |
| ***F24C 15/20*** | (2006.01) |
| ***F24F 13/02*** | (2006.01) |

(52) U.S. Cl.

CPC ..... *F24F 13/0254* (2013.01); *F24F 13/0209* (2013.01); *F24F 13/0245* (2013.01); *F24C 15/2071* (2013.01)

(58) Field of Classification Search

CPC ..... F24F 13/0209; F24F 13/0245; F24F 13/0254; F24F 13/084; F24C 15/2071

See application file for complete search history.

(56) References Cited

U.S. PATENT DOCUMENTS 2,977,869 A * 4/1961 Cortland ..... F24F 13/062 454/300
2020/0263887 A1* 8/2020 Mergener ..... F24F 7/013

FOREIGN PATENT DOCUMENTS

JP 2000274808 A * 10/2000

OTHER PUBLICATIONS

Tanaka, JP2000274808 and translation (Year: 2000).*
"AirKing Ventilation Products; SEV24S Power Packs Specifications" (7 pages).
"GE Appliances UVC7300 Owner's Manual and Installation Instructions" (40 pages).
"XOI21SMUA Insert" (8 pages).
"Range Hood Model EAS422SS Use, Care and Installation Guide," dated Mar. 2019 (36 pages).

* cited by examiner

*Primary Examiner* — Steven S Anderson, II
(74) *Attorney, Agent, or Firm* — Barnes & Thornburg LLP

(57) ABSTRACT

A ventilation unit includes a housing including a plurality of walls defining an interior space. The housing may be mounted to a structure, such as a cabinet, using a plurality of primary mounts. A mount is coupled to the housing to mount the housing to the structure. The mount may be used prior to installation of the primary mounts.

20 Claims, 12 Drawing Sheets

VARIABLE HEIGHT INSTALLATION MECHANISM

PRIORITY CLAIM

This application claims priority under 35 U.S.C. § 119(e) to U.S. Provisional Application Ser. No. 63/167,253, filed Mar. 29, 2021, which is expressly incorporated by reference herein.

BACKGROUND

The present disclosure relates to a ventilation unit, and particularly to a ventilation unit including an installation system. More particularly, the present disclosure relates to a ventilation unit having an installation system with a plurality of fasteners that secure the ventilation unit to surrounding structures.

SUMMARY

According to the present disclosure, a ventilation unit includes a housing including a plurality of walls defining an interior space. The ventilation unit may further include a temporary mount coupled to the housing and configured to at least temporarily couple the housing to the structure so that a user installing the housing on the structure can use both hands to install a plurality of primary mounts without having to hold the housing.

In some embodiments, the temporary mount includes an attachment flange configured to secure to the housing in a fixed position, an arm extending from the attachment flange, and a plurality of retainers that extend away from the arm on an opposite end of the arm from the attachment flange. In some embodiments, an upper end of each retainer extends above a top wall of the housing and engages a portion of the housing to provide a pivot point for each of the retainers as the ventilation system is installed. In some embodiments, the temporary mount further includes a first release lever coupled to the first retainer and a second release lever coupled to the second retainer.

In some embodiments, the plurality of retainers includes a first retainer and a second retainer that cooperate to provide variable-height, temporary attachment means to the structure. In some embodiments, the first retainer includes a first bottom edge and a first sloped upper edge and the second retainer includes a second bottom edge and a second sloped upper edge, and wherein the first bottom edge is located closer to the arm than the second bottom edge. In some embodiments, the first retainer extends to a first width from the arm and the second retainer extends to a second width from the arm, the second width being greater than the first width.

In some embodiments, the temporary mount includes an attachment flange configured to secure to the housing in a fixed position, a first arm extending from the attachment flange, a second arm coupled to the extending from the attachment flange, a first retainer coupled to the first arm, and a second retainer coupled to the second arm.

According to another aspect of the present disclosure, a ventilation unit includes a housing and an installation system. The housing includes a plurality of walls defining an interior space. The installation system is configured to retain the housing to a structure. In some embodiments, the installation system includes a plurality of primary mounts and a temporary mount coupled to the housing and configured to at least temporarily couple the housing to the structure so that a user installing the housing on the structure can use both hands to install the plurality of primary mounts without having to hold the housing.

In some embodiments, the temporary mount includes an attachment flange configured to secure to the housing in a fixed position, an arm extending from the attachment flange, and a plurality of retainers that extend away from the arm on an opposite end of the arm from the attachment flange. In some embodiments, the attachment flange is mounted to an interior surface of the housing such that the attachment flange and the arm are located within an interior space defined by the housing, and wherein the housing is formed to include a plurality of slots and each retainer passes through a corresponding slot included in the plurality of slots from the interior space to outside the interior space.

In some embodiments, an upper end of each retainer extends above a top wall of the housing outside the interior space and engages a portion of the housing to provide a pivot point for each of the retainers as the ventilation system is installed. In some embodiments, the arm is configured to flex and at least one of the plurality of retainers is configured to withdraw into the interior space as the ventilation system is installed on the structure.

In some embodiments, the plurality of retainers includes a first retainer and a second retainer that cooperate to provide variable-height, temporary attachment means to the structure, and wherein the first retainer includes a first bottom edge and a first sloped upper edge and the second retainer includes a second bottom edge and a second sloped upper edge, and wherein the first bottom edge is located closer to the arm than the second bottom edge. In some embodiments, the first retainer extends to a first width from the arm and the second retainer extends to a second width from the arm, the second width being greater than the first width.

In some embodiments, the temporary mount includes an attachment flange configured to secure to the housing in a fixed position, a first arm extending from the attachment flange, a second arm coupled to the extending from the attachment flange, a first retainer coupled to the first arm, and a second retainer coupled to the second arm.

According to another aspect of the present disclosure, a ventilation unit includes a housing and a mount. The housing may include a plurality of walls defining an interior space. The mount is coupled to the housing and is configured to at least temporarily couple the housing to a structure.

In some embodiments, the mount includes a first end fixed to one wall included in the plurality of walls and a second end spaced apart from the first end and movable relative to the housing. In some embodiments, the mount includes at least one retainer coupled to the second end and, during installation, the mount is configured to change from an undeformed position in which an end of the retainer is spaced from the housing a first distance and a deformed position in which the end of the retainer is spaced apart from the housing a second distance less than the first distance.

In some embodiments, the mount includes an attachment flange at the first end and configured to secure to the housing in a fixed position, an arm extending from the attachment flange, and a plurality of retainers that extend away from the arm on the second end of the arm spaced apart from the attachment flange. In some embodiments, the attachment flange is mounted to an interior surface of the housing such that the attachment flange and the arm are located within an interior space defined by the housing, and wherein the housing is formed to include a plurality of slots and each retainer passes through a corresponding slot included in the plurality of slots from the interior space to outside the interior space.

In some embodiments, the plurality of retainers includes a first retainer and a second retainer that cooperate to provide variable-height, attachment means to the structure, and wherein the first retainer includes a first bottom edge and a first sloped upper edge and the second retainer includes a second bottom edge and a second sloped upper edge, and wherein the first bottom edge is located closer to the arm than the second bottom edge.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

DETAILED DESCRIPTION

Figure 1:
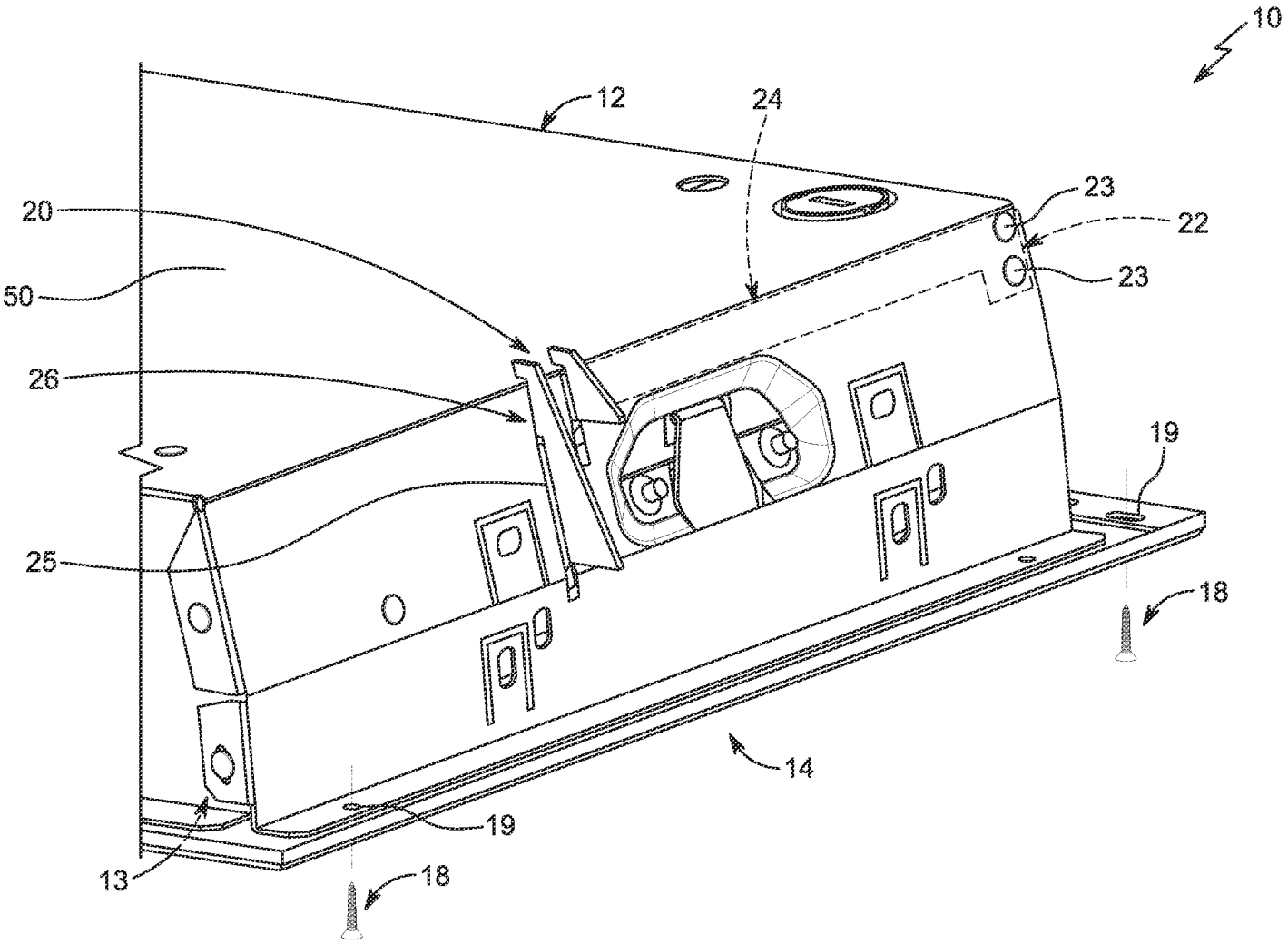
FIG. 1 is a partial perspective view of a ventilation unit including a housing and an installation system for mounting the housing to structures of a building.

A ventilation unit 10 includes a housing 12 as shown in FIG. 1. In the illustrative embodiment, the housing 12 is a range hood 12 that is configured to be mounted above a stove top, however, in other embodiments, the housing 12 may be a part of a different type of ventilation unit such as a bathroom fan located above a ceiling or within a wall of a building (not shown). A blower or fan (not shown) may be coupled to the housing 12 either directly or via a duct to draw air through the housing 12 for ventilation purposes. One or more filters and/or grilles (not shown) may also be coupled to the housing 12.

The ventilation unit 10 further includes an installation system 14 that mounts the housing 12 to one or more structures such as a cabinet 16 (see FIGS. 2 and 3), ceiling joist(s), framing, or any other suitable structure of the building or fixture coupled to the building, for example. The installation system 14 includes a plurality of primary mounts 18 and a pair of temporary mounts 20 coupled to the housing 12. The plurality of primary mounts 18 are illustratively embodied as fasteners (i.e. screws, nails, bolts, studs, etc.) which extend through corresponding openings 19 formed in the housing 12 and into the structure to which the housing 12 is mounted (in this case a cabinet 16). The pair of temporary mounts 20 are configured to engages portions of the structure to which the housing 12 is mounted to temporarily hold the housing 12 at or near a fully-installed position so that the person installing the housing 12 is free to use both hands while installing the primary mounts 18. Thus, if a single person is installing the ventilation unit 10, the person does not have to hold the ventilation unit 10 in position relative to the structure while simultaneously installing the primary mounts 18.

Only one temporary mount 20 is shown in FIGS. 1-7, however, it should be appreciated that a substantially similar temporary mount 20 may also be coupled to an opposite side of the housing 12 from what is shown in FIG. 1. Each temporary mount 20 includes an attachment flange 22 configured to be coupled to the housing 12. An arm 24 has a first end and a second end. The first end of the arm 24 extends from the attachment flange 22. A plurality of retainers 26 (or at least one retainer 26) extends from the second end of the arm 24. The attachment flange 22 is configured to be fixed to an inside wall of the housing 12 by one or more fasteners 23. The arm 24 interconnects the attachment flange 22 and the plurality of retainers 26. Each of the plurality of retainers 26 is configured to extend through a corresponding opening 25 defined in the housing 12 to reside outside of an interior space 13 defined by the housing 12. The plurality of retainers 26 are configured to engage the structure to which the housing 12 is mounted to temporarily hold the housing 12 in place prior to full installation.

Figure 2:
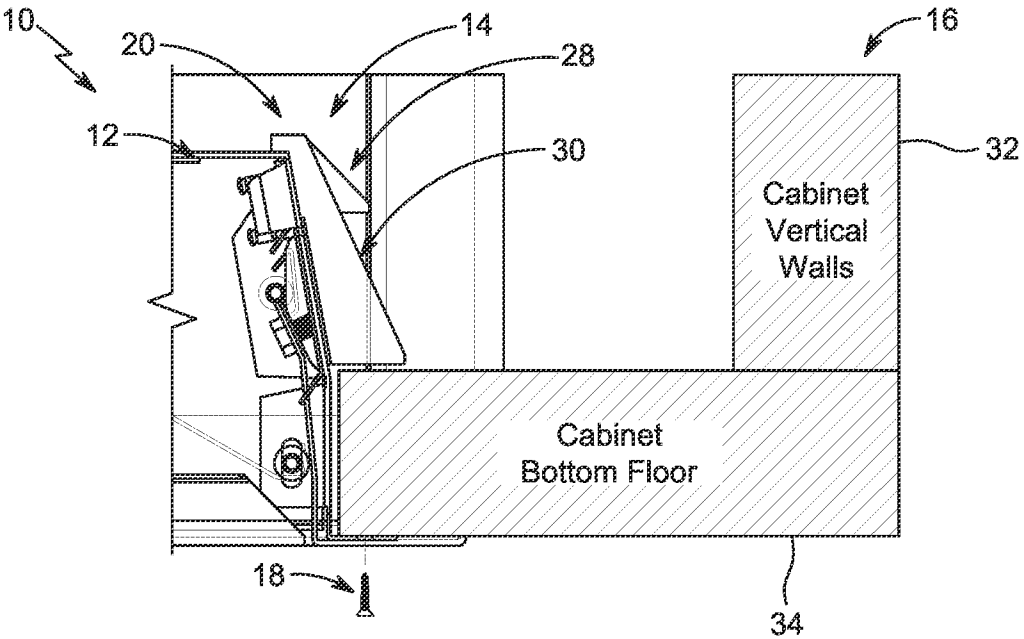
FIG. 2 is a side elevation view of a portion of the ventilation unit of FIG. 1 positioned relative to cabinet structures showing that the installation system includes a temporary mount that holds the housing relative to the cabinet structures as one or more primary mounts are installed.

In the depicted embodiment, the plurality of retainers 26 includes a first retainer 28 and a second retainer 30 to provide temporary installation of the housing 12 at two different heights. In this way, the housing 12 may be temporarily held in place for subsequent, full installation with primary mounts 18 no matter the size, form, or dimensions of the structure to which the housing 12 is installed. For example, the cabinet 16 may include a vertical side wall 32 and a bottom wall 34 as shown in FIG. 2. The second retainer 30 may be used in this situation to rest on top of the bottom wall 34 of the cabinet 16 and temporarily hold the housing 12 at or near a full-installation position relative to the cabinet 16. Depending on a thickness of the bottom wall 34, the first retainer 28 may be used to temporality hold the housing 12 in place instead of the second retainer 30. The plurality of retainers 26 may further include additional retainers with portions between the first retainer 28 and the second retainer 30 for retaining the housing 12 at additional heights relative to the structure.

Figure 3:
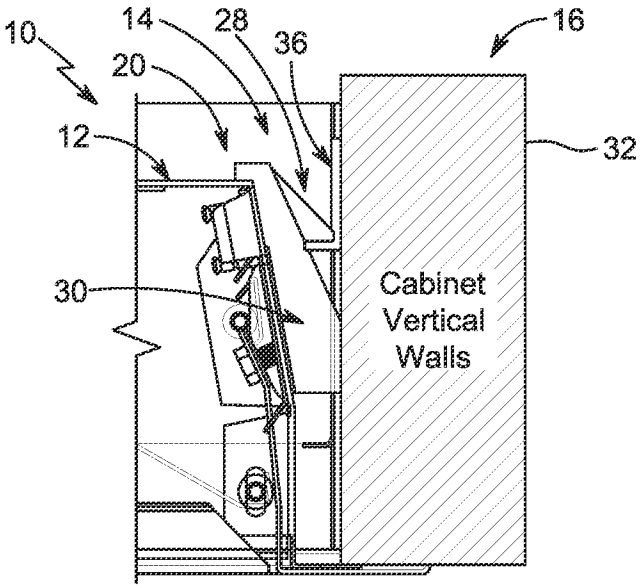
FIG. 3 is another side elevation view of the ventilation unit of FIG. 1 mounted to another type of cabinet structure using a temporary retainer feature.

In another example, the cabinet 16 includes only the vertical side wall 32 as shown in FIG. 3 without a bottom wall. A separate attachment bracket 36 may be installed on the inside of the vertical side wall 32. The first retainer 28 is configured to engage the attachment bracket 36 to temporarily hold the housing 12 in place relative to the cabinet 16 prior to full installation with primary mounts 18. The separate attachment bracket 36 may alternatively be located on the structure such that the second retainer 30 is configured to engage and rest on the attachment bracket 36 to temporarily hold the housing 12 in place relative to the cabinet 16 prior to full installation.

Figure 4:
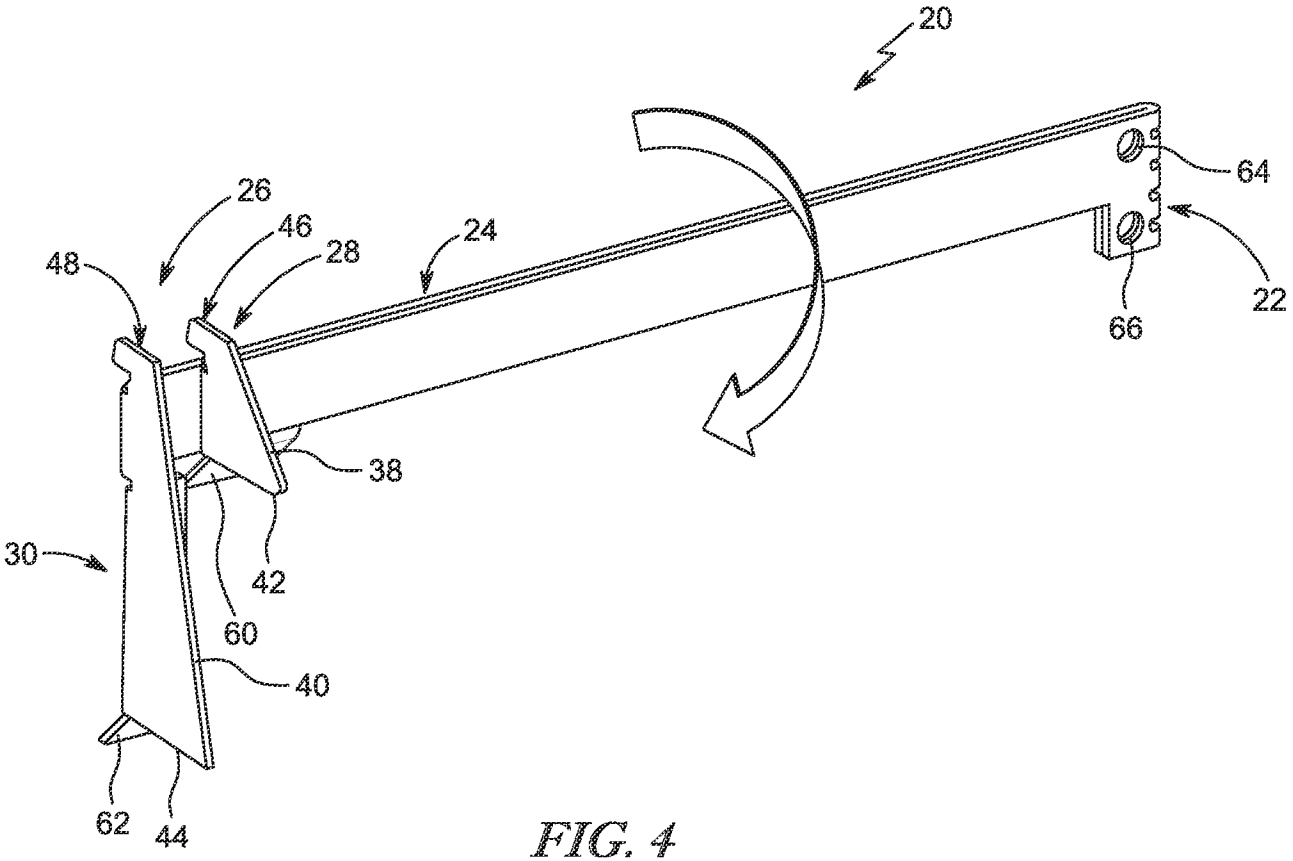
FIG. 4 is a perspective view of the temporary mount of the ventilation unit of FIG. 1.

The arm 24 is configured to flex as the housing 12 is being installed, as depicted in FIG. 4. Each of the retainers 28, 30 includes a sloped upper edge 38, 40 and a generally horizontal bottom edge 42, 44. The sloped upper edges 38, 40 are configured to engage the bottom wall 32 or the attachment bracket 36 while the housing 12 is being installed and cause the arm 24 to flex inward and the retainers 26 to retract into the interior 13 out of the way of the bottom wall 34 of the cabinet 16 or the attachment bracket 36. Once either the first retainer 28 or the second retainer have cleared the bottom wall 34 or the attachment bracket 36, the arm 24 returns to an at least partially undeformed position where one or both of the retainers 26 temporarily hold the housing 12 during subsequent full installation as discussed above.

Figure 6:
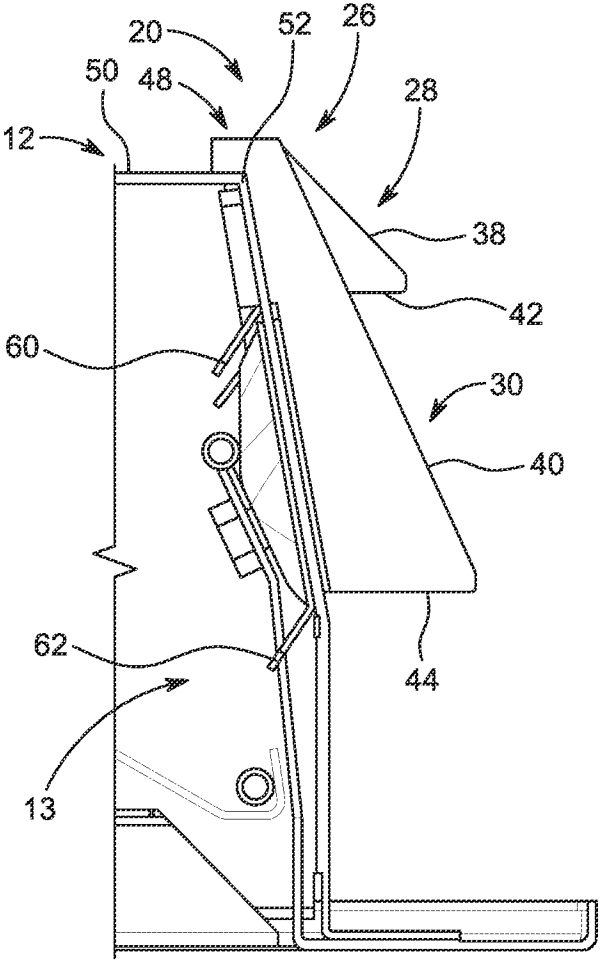
FIG. 6 is a front view of the ventilation unit of FIG. 1 showing the temporary mount coupled to the housing of the ventilation unit.

In the illustrative embodiment, the arm 24 and the retainers 26 are configured to twist relative to the housing 12 as suggested in FIG. 4. One or both of the retainers 28, 30 may further include a hook 46, 48 that engages the housing 12 to block a portion of the retainers 26 from retracting into the interior 13 of the housing 12 as shown in FIGS. 1, 4, and 6. The hooks 46, 48 overlay a top wall 50 of the housing 12 and are arranged to lie outside of the interior 13 of the housing 12. Only a lower portion of each retainer 26 retracts into the interior 13 of the housing 12 as the arm 24 flexes. Thus, the top wall 50 of the housing 12 provides a pivot point 52 about which the retainers 26 pivot as the arm 24 flexes. In some embodiments, the hooks 46, 48 are omitted and the arm 24 and the retainers flex linearly relative to the housing 12.

Figure 5:
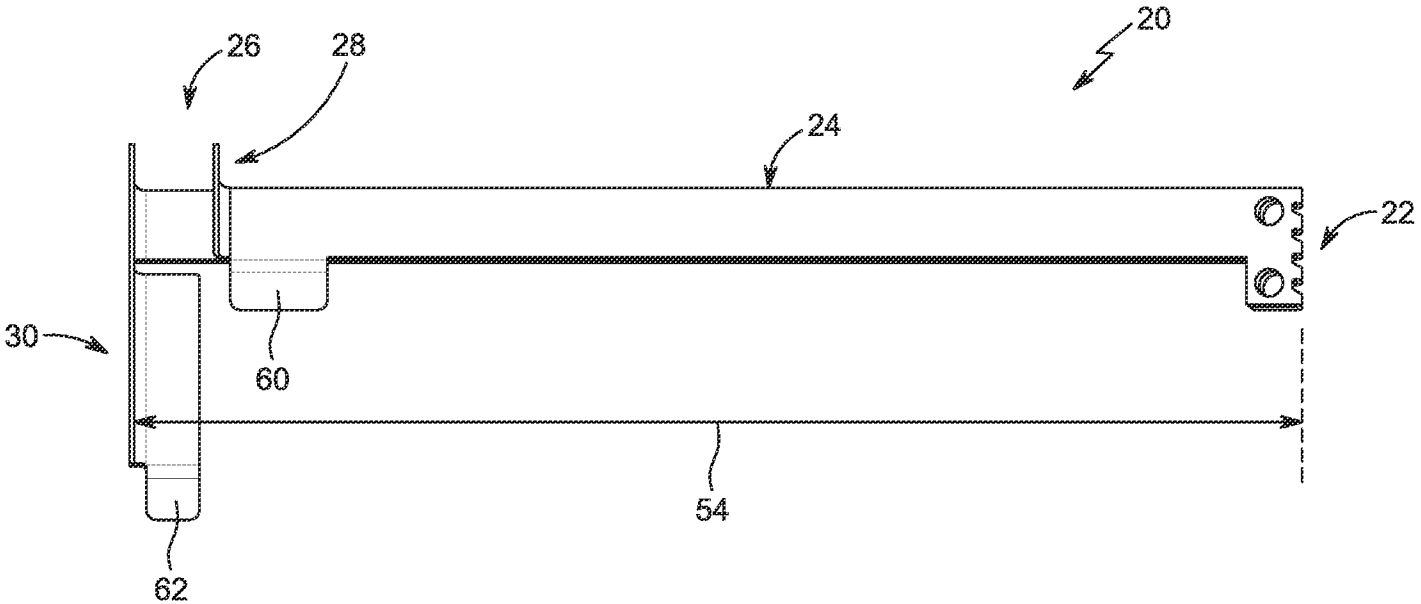
FIG. 5 is a side elevation view of the temporary mount of FIG. 4.

The first retainer 28 and the second retainer 30 are spaced apart from one another along a length 54 of the temporary mount 20 as shown in FIG. 5. The first retainer 28 is located closer to the attachment flange 22 compared to the second retainer 30. The bottom edge 42 of the first retainer 28 is located closer to the arm 24 compared to the bottom edge 44 of the second retainer 30. When the arm 24 and the retainers 26 flex relative to the housing 12 and the attachment flange 22, the bottom edge 44 of the second retainer 30 retracts a greater distance compared to the bottom edge 42 of the first retainer 28. In some embodiments, the first and second retainers 28, 30 may be located an equal distance from the attachment flange 22 relative to the length 54 of the temporary mount 20.

Figure 7:
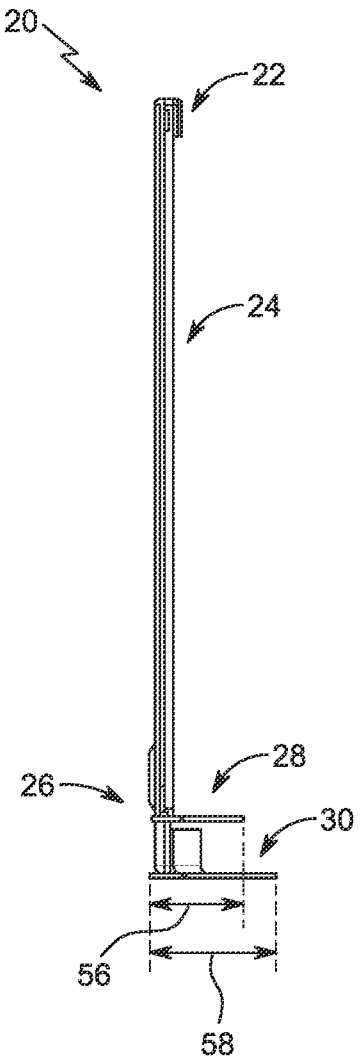
FIG. 7 is a top view of the temporary mount of FIG. 4.

The first retainer 28 extends to a first width 56 from the arm 24 and the second retainer 30 extends to a second width 58 from the arm 24 as shown in FIG. 7. The first width 56 is less than the second width 58 to account for the greater distance in which the second retainer 30 will retract when the arm 24 flexes. In some embodiments, the widths 56, 58 may be equal.

Each of the retainers 28, 30 further includes a release lever 60, 62 as shown in FIGS. 4-6. The release levers 60, 62 extend from lower ends of each respective retainer 28, 30 and are arranged to lie within the interior 13 of the housing 12. The release levers 60, 62 may be engaged by a user to manually flex the arm 24 and the retainers 26 thereby retracting the retainers 26 into the interior 13 and disengage the retainers 26 from the bottom wall 34, attachment bracket 36 or another structure to which the retainers 26 are coupled so that the housing 12 can be separated or uninstalled from the cabinet 16.

In some embodiments, on the inner side of the housing 12, release levers 60, 62 are provided (integral with the dual level snapping action arm), in order to allow the end user to unlatch the ventilation unit 10 from the cabinetry 16, should a major overhaul of the unit be required. A twisting motion may occur when the first and second retainers 28, 30 are triggered. The other extremity of the arm (i.e. attachment flange 22) is rigidly attached to the housing 12 by two anchoring points, represented by two holes 64, 66 (intended for rivets 23 or another suitable fastener).

The temporary mount 20 may snap to the housing 12 in the following installation configurations: The second retainer 30 member may be used for installations where the cabinet bottom wall 34 is present after a cutout has been formed in the cabinet 16 by the installer. The first retainer 28 may be used for tighter installation configurations, where there is no cabinet bottom wall 34 after the cutout has been formed. In this case, a supplementary L-shaped bracket 36 may be installed to the cabinet 16, in order to allow the first retainer 28 to engage the bracket 36 and hold the housing 12 to the cabinet 16.

Figure 8:
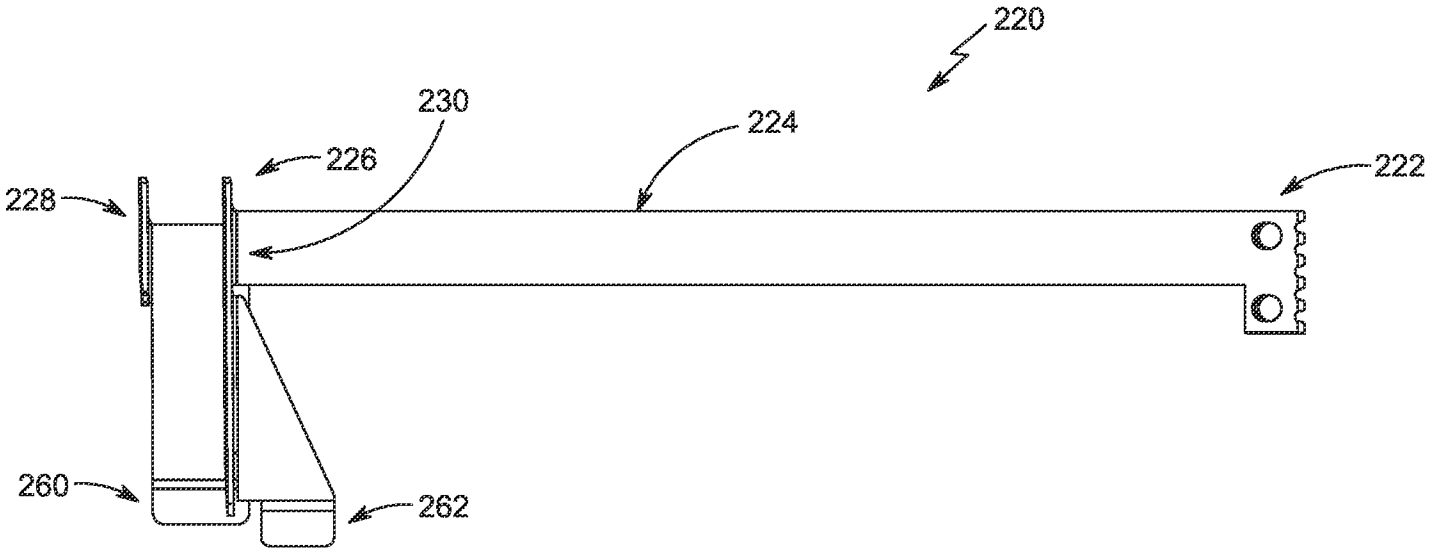
FIG. 8 is a side elevation view of another embodiment of a temporary mount that can be used with the ventilation unit of FIG. 1.
Figure 10:
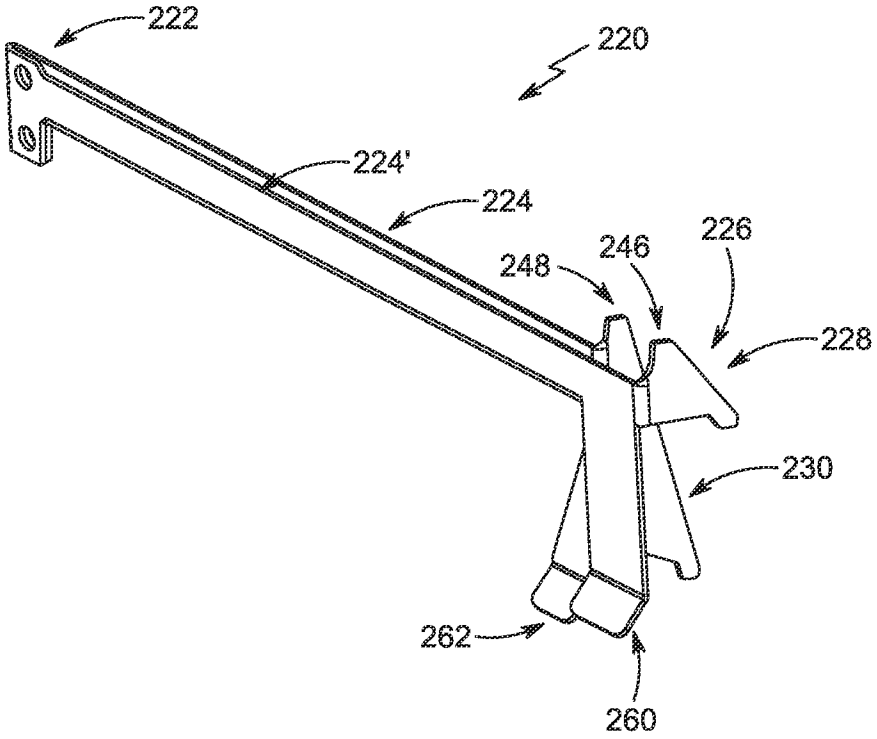
FIG. 10 is a perspective view of the temporary mount of FIG. 8.
Figure 9:
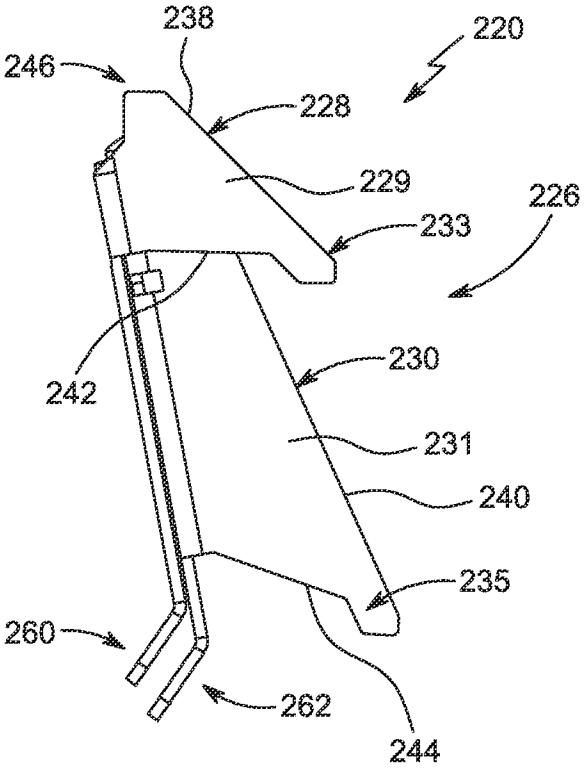
FIG. 9 is a front view of the temporary mount of FIG. 8.

Another embodiment of a temporary mount 220, in accordance with the present disclosure, is shown in FIGS. 8-10. The temporary mount 220 is similar to temporary mount 20. Accordingly, similar reference numbers in the 200 series are used to designate similar features between temporary mount 220 and temporary mount 20. The disclosure of temporary mount 20 is incorporated by reference herein for temporary mount 220 except for the differences expressly described below.

Each temporary mount 220 includes an attachment flange 222 configured to be coupled to the housing 12. An arm 224 has a first end and a second end. The first end of the arm 224 extends from the attachment flange 222. A plurality of retainers 226 extends from the second end of the arm 224. The attachment flange 222 is configured to be fixed to an inside wall of the housing 12 by one or more fasteners. The arm 224 interconnects the attachment flange 222 and the plurality of retainers 226.

In the depicted embodiment, the plurality of retainers 226 includes a first retainer 228 and a second retainer 230 to provide temporary installation of the housing 12 at two different heights. The arm 224 is configured to flex as the housing 12 is being installed. Each of the retainers 228, 230 includes main body 229, 231 having a sloped upper edge 238, 240 and a bottom edge 242, 244, and a nose 233, 235 extend from a distal end of the main body 229, 231 relative to the arm 224. The sloped upper edges 238, 240 are configured to engage the bottom wall 32 or the attachment bracket 36 while the housing 12 is being installed and cause the arm 224 to flex inward and the retainers 226 to retract into the interior 13 out of the way of the bottom wall 34 of the cabinet 16 or the attachment bracket 36. Once either the first retainer 228 or the second retainer 230 have cleared the bottom wall 34 or the attachment bracket 36, the arm 224 returns to an at least partially undeformed position where one or both of the retainers 226 temporarily hold the housing 12 during installation as discussed above. The noses 233, 235 extend downwardly below each respective bottom surface 242, 244 and are configured to engage the bottom wall 34 or the bracket 36 to retain the housing 12 in place.

Figure 11:
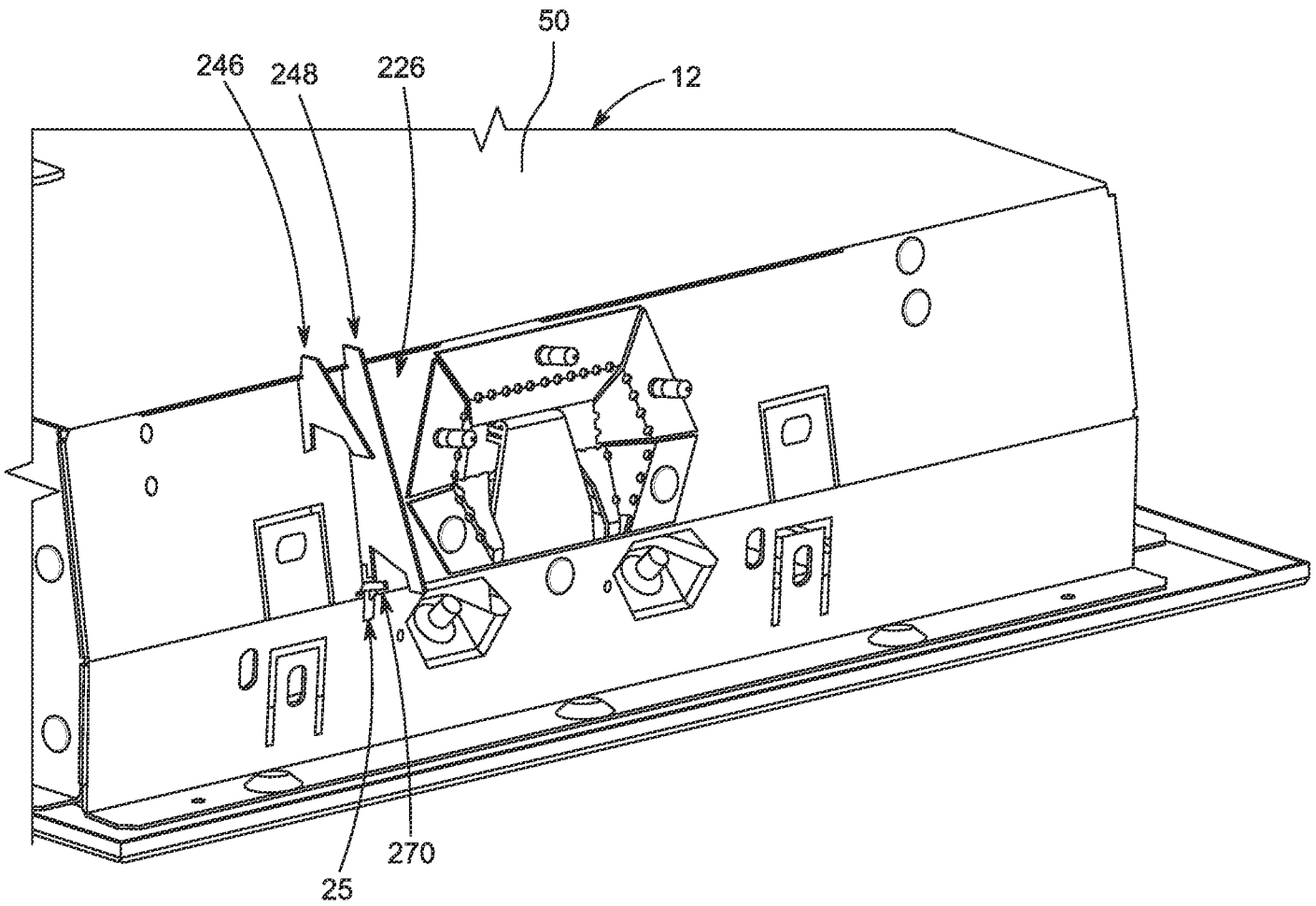
FIG. 11 is a partial perspective view of a ventilation unit with the temporary mount of FIGS. 8-10 coupled thereto.

In the illustrative embodiment, the arm 224 and the retainers 226 are configured to twist relative to the housing 12 when the temporary mount flexes during installation. One or both of the retainers 228, 230 may further include an upper end 246, 248 that extends above a top wall 50 of the housing 12 and engages the housing 12 to block a portion of the retainers 226 from retracting into the interior 13 of the housing 12 as shown in FIG. 11. The upper ends 246, 248 are arranged to lie outside of the interior 13 of the housing 12. Only a lower portion of each retainer 226 retracts into the interior 13 of the housing 12 as the arm 224 flexes. Thus, the top wall 50 of the housing 12 provides a pivot point 52 about which the retainers 226 pivot as the arm 224 flexes. In some embodiments, the upper ends 246, 248 are omitted and the arm 224 and the retainers flex linearly relative to the housing 12.

The first retainer 228 and the second retainer 230 are spaced apart from one another along a length of the temporary mount 220 as shown in FIG. 8. The first retainer 228 is located further from the attachment flange 222 compared to the second retainer 230. The bottom edge 242 of the first retainer 228 is located closer to the arm 224 compared to the bottom edge 244 of the second retainer 230. When the arm 224 and the retainers 226 flex relative to the housing 12 and the attachment flange 222, the bottom edge 244 of the second retainer 230 retracts a greater distance compared to the bottom edge 242 of the first retainer 228. In some embodiments, the first and second retainers 228, 230 may be located an equal distance from the attachment flange 222 relative to the length of the temporary mount 220.

Figure 12:
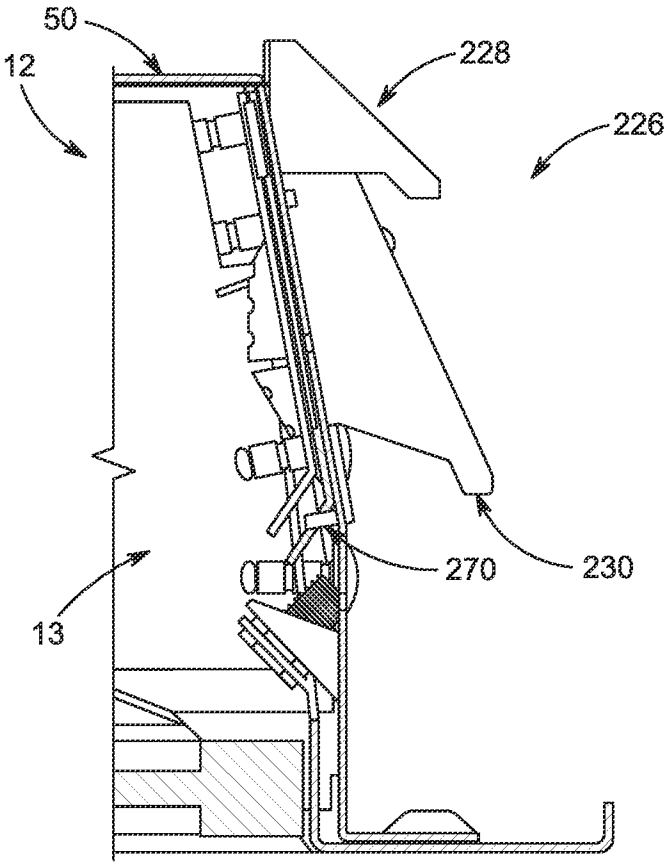
FIG. 12 is a front view of the ventilation unit and the temporary mount of FIG. 11 with portions removed.

Each temporary mount 220 may be formed from a single piece of material (e.g. metal) or multiple pieces of material and is machined and/or deformed to provide the various features included in each temporary mount 220. In the embodiment depicted in FIGS. 10-12, the temporary mount 220 comprises both a first arm 224', and a second arm 224 that extend from the attachment flange 222 in side-by-side, parallel relation to one another as shown in FIG. 10. The first retainer 228 extends from arm 224' while the second retainer 230 extends from the second arm 224. In this way, the first retainer 228 may be movable relative to the second retainer 230.

Each of the retainers 228, 230 further includes a release lever 260, 262. The release levers 260, 262 extend from lower ends of each respective retainer 228, 230 and are arranged to lie within the interior 13 of the housing 12. The release levers 260, 262 may be engaged by a user to manually flex the arms 224, 224' and the retainers 226 thereby retracting the retainers 226 into the interior 13 to disengage the retainers 226 from the bottom wall 234, attachment bracket 236 or another structure to which the retainers 226 are coupled so that the housing 12 can be separated or uninstalled from the cabinet 16. The release lever 262 coupled to the second retainer 230 extends at least partially over the other release lever 260 so that movement of the release lever 262 in a releasing direction will also move the other release lever 260 to flex both of the retainers 226 at the same time. The release lever 260 may be independently moveable relative to release lever 262.

In another embodiment, the housing 12 may include a stopper 270 that extends across one or more of the slots 25 defined in the housing 12 and through which the retainers 226 extend. The stopper is configured to block full retraction of the retainers 226 into the interior 13 of the housing 12 (such as be catching the nose 235 of the second retainer 230, as depicted in FIG. 11) and thereby prevent the retainers 226 from being stuck against the housing 12 in a retracted position.

Another embodiment of an attachment bracket 336 that can be used to at least temporarily mount the housing 12 to the cabinet 16 is shown in FIGS. 13-16. The attachment bracket 336 may be coupled to an inside surface of a vertical cabinet wall 32 and can be oriented or structured in various ways to mount the housing within spaces between cabinets of varying widths as suggested in FIGS. 14-16.

Figure 13:
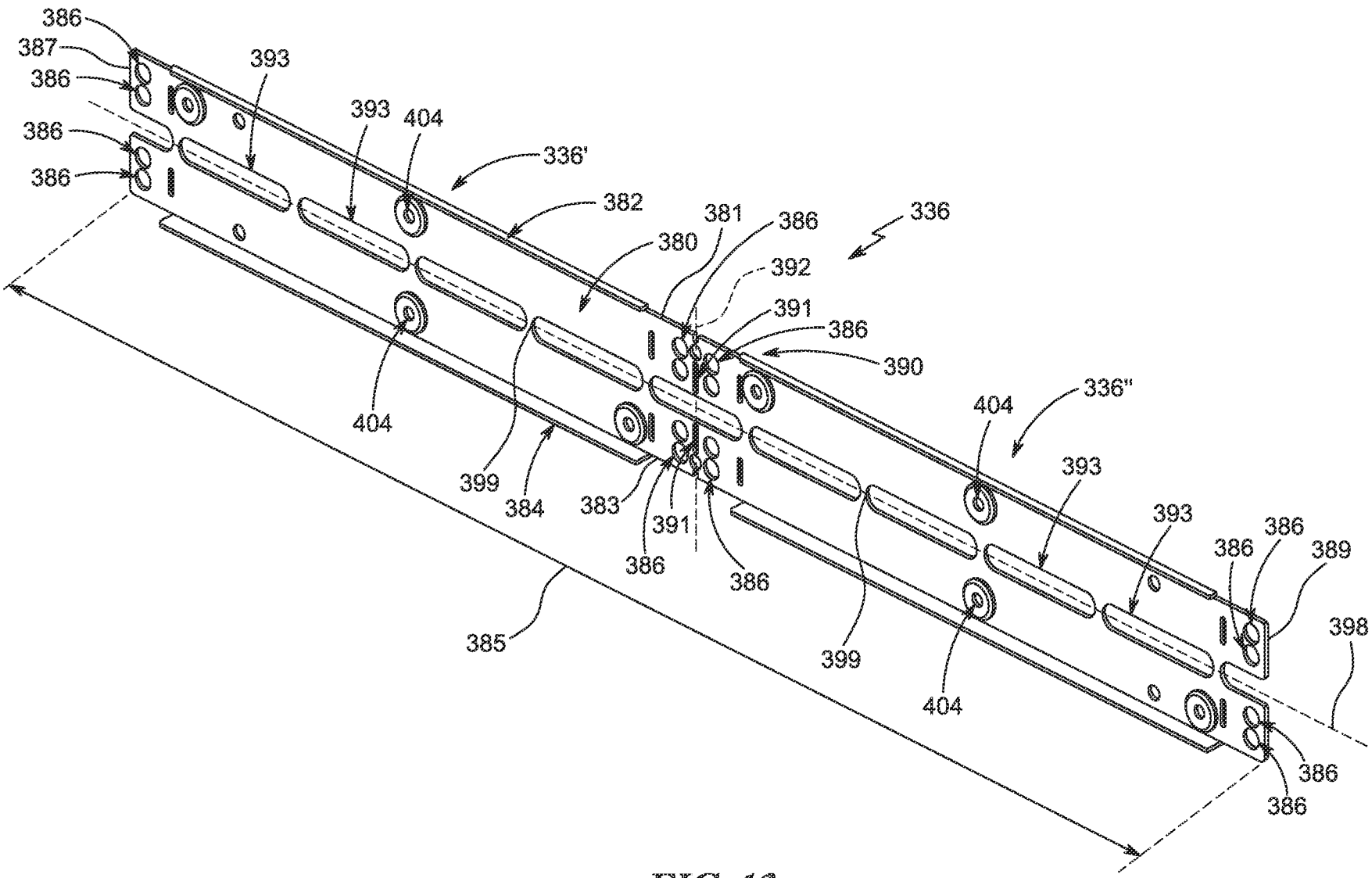
FIG. 13 is a perspective view of an attachment bracket that can be included in the installation system of the present disclosure.

The attachment bracket 336 includes an attachment panel 380, a first mount flange 382 coupled to a first end 381 of the attachment panel 380, and a second mount panel 384 coupled to a second, opposite second end 383 of the attachment panel 380 as shown in FIG. 13. The attachment panel 380 is configured to be fixed to the inside surface of the vertical wall 32 of the cabinet 16 (or another structure) to mount the attachment bracket 336 to the vertical wall 32. The first mount flange 382 and the second mount flange 384 each extend away from the attachment panel 380 at a generally 90 degree angle relative to the attachment panel 380. One or both of the first mount flange 382 and the second mount flange 384 may engage a retainer 26, 226 during installation of the housing 12 to at least temporarily hold the housing 12 in place for subsequent full installation.

The attachment panel 380 is formed to define a plurality of fastener openings 386 arranged at different locations along a length 385 of the attachment panel 380 as shown in FIG. 13. The plurality of fastener openings 386 are configured to receive a fastener (not shown) that extend into the vertical wall 32 to secure the attachment bracket 336 to the cabinet 16 (or other structure). The plurality of fastener openings 386 are arranged to lie at longitudinal ends 387, 389 of the attachment panel 380.

Some fastener openings 386 may also be formed in a central area 390 of the attachment panel 380. In the illustrative embodiment, the attachment panel 380 is also formed to include vertical cutouts 391 that are arranged along a line 392 extending across a vertical width of the attachment panel 380. The vertical cutouts 391 provide a frangible breakaway point where the attachment bracket 336 can be broken (i.e. by repetitive bending) to divide the attachment bracket 336 into a plurality of sections 336', 336". One or more sections 336', 336" can be installed on a vertical wall 32 to fit structures having various depths. Each section 336', 336" includes first and second mount flanges 382, 384 and fastener openings 386 at their respective longitudinal ends.

Figure 15:
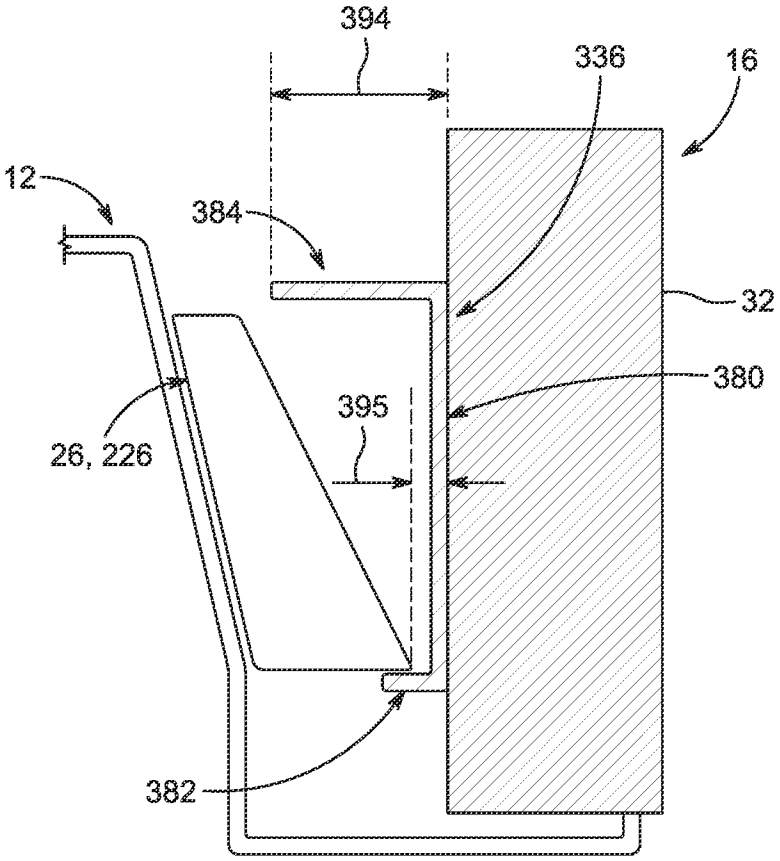
FIG. 15 is a side elevation view of the attachment bracket of FIG. 13 mounted to a vertical wall in a second orientation.
Figure 14:
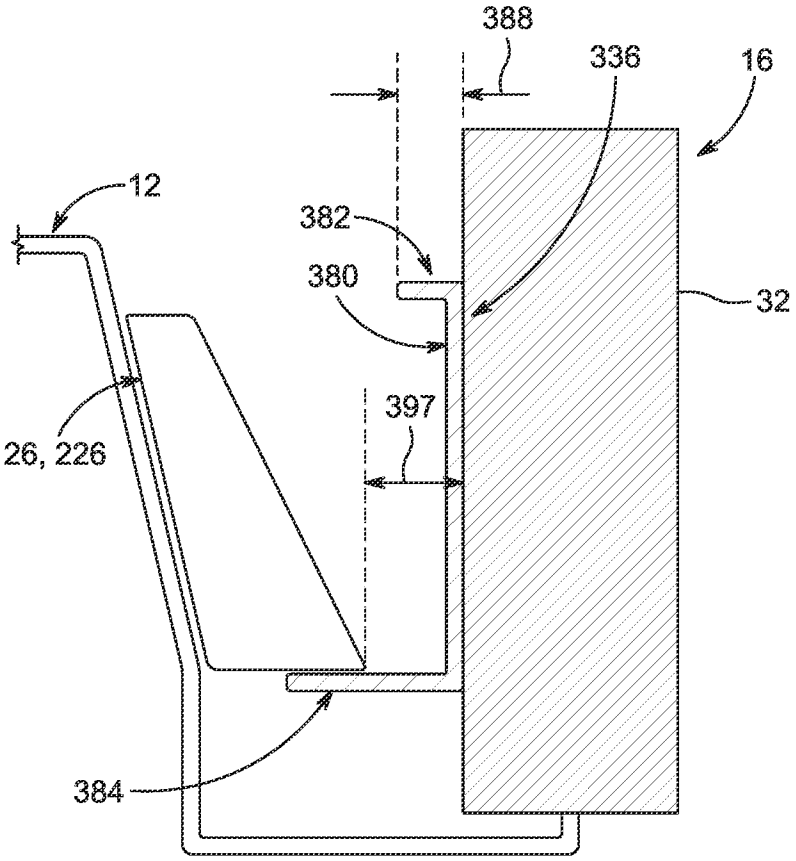
FIG. 14 is a side elevation view of the attachment bracket of FIG. 13 mounted to a vertical wall in a first orientation.

The first mount flange 382 has a first width 388 and the second mount flange 384 has a second width 394 as shown in FIGS. 14 and 15. The first width 388 is less than the second width 394 so that either the first mount flange 382 or the second mount flange 384 can be used depending on spacing between the vertical wall 32 and the retainer 26, 226. For example, the attachment bracket 336 can be oriented so that the second mount flange 384 is on a bottom of the attachment bracket 336 if a space 397 between a distal end of the retainer 26, 226 and the vertical wall 32 is relatively large as shown in FIG. 14. On the other hand, the attachment bracket 336 can be oriented so that the first mount flange 382 is on a bottom of the attachment bracket 336 if a space 395 between the distal end of the retainer 26, 226 and the vertical wall 32 is relatively small as shown in FIG. 15.

Figure 16:
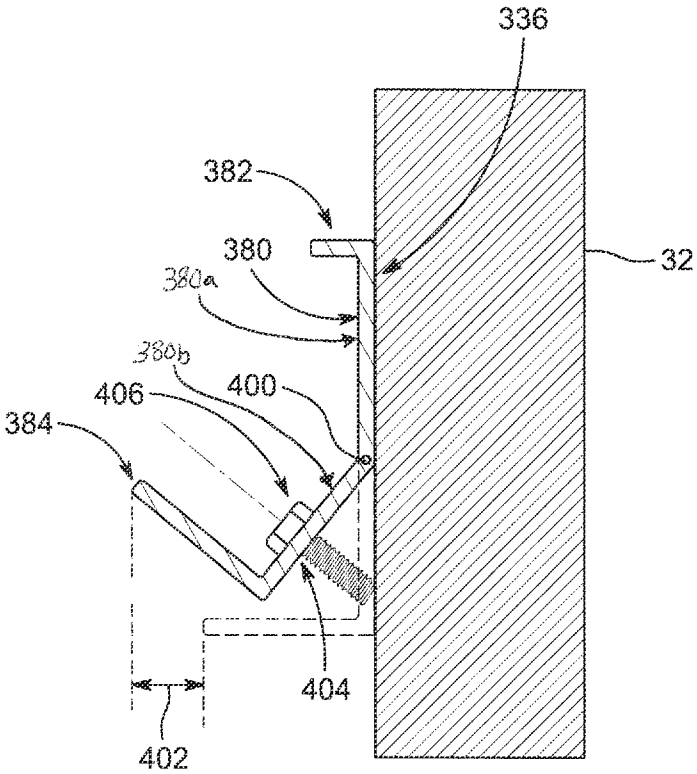
FIG. 16 is a side elevation view of the attachment bracket of FIG. 13 mounted to a vertical wall and adjusted relative to the side wall.

The attachment panel 380 defines a plurality of horizontal apertures 393 that extend along a horizontal line 398 along the length 385 of the attachment panel 380. The horizontal apertures 393 are formed in the shape of an elongated oval each separated by a divider material section 399. Each divider material section 399 has a length that is less than a length of each horizontal aperture 393 so that the attachment bracket 336 can be deformed along a pivot point 400 at the horizontal line 398 as shown in FIG. 16. Deforming the attachment panel 380 about pivot point 400 allows a user to increase the second width 394 by a distance 402 if spacing between the distal end of the retainer 26, 226 and the mount flanges 382, 384 is too large to reach either mount flange 382, 384 and support the housing 12. In particular, if the attachment panel 380 is deformed about the pivot line 400, the attachment panel 380 defines a proximal portion 380*a* configured to be secured to the vertical wall 32 and an extended portion 380*b* extending away from the vertical wall 32 locating the second mount panel 384 further away from the vertical wall 32.

Attachment panel 380 may also be defined to include one or more support apertures 404 that receive a support 406 (depicted as a bolt) as shown in FIGS. 13 and 16. The support(s) 406 are configured to transfer loads between the portion of the attachment bracket 336 that is deformed about pivot point 400 and the vertical wall 32 to maintain the attachment bracket 336 in its deformed position. Surfaces defining the support apertures 404 may be threaded to interact with threads on each support 406. In some embodiments, the divider material sections 399 may have a strength sufficient to retain the attachment bracket 336 in its deformed position while supporting the housing 12 such that the support 406 and apertures 404 can be omitted.

The invention claimed is:

1. A ventilation unit comprising:

a housing including a plurality of walls defining an interior space, the plurality of walls defining
- an interior surface of the housing
- an exterior surface of the housing, and
- at least one slot defined through one or more of the plurality of walls; and a temporary mount comprising
- an attachment flange secured to the housing,
- an arm having a first end extending from the attachment flange and a second, opposing, end, and
- a plurality of retainers extending from the arm;

wherein the plurality of retainers are configured to pass through the at least one slot and at least temporarily engage a structure outside of the housing.

2. The ventilation unit of claim 1, wherein the plurality of retainers extend away from the arm on the second end of the arm.

3. The ventilation unit of claim 2, wherein an upper end of each retainer extends above a top wall of the housing and engages a portion of the housing to provide a pivot point for each of the retainers as the ventilation system is installed.

4. The ventilation unit of claim 2, wherein the temporary mount further comprises a first release lever coupled to the first retainer and a second release lever coupled to the second retainer.

5. The ventilation unit of claim 1, wherein the plurality of retainers comprises a first retainer and a second retainer.

6. The ventilation unit of claim 5, wherein the first retainer comprises a first bottom edge and a first sloped upper edge and the second retainer comprises a second bottom edge and a second sloped upper edge, and wherein the first bottom edge is located closer to the arm than the second bottom edge.

7. The ventilation unit of claim 6, wherein the first retainer extends to a first width from the arm and the second retainer extends to a second width from the arm, the second width being greater than the first width.

8. The ventilation unit of claim 1, the temporary mount comprising a second arm extending from the attachment flange and a second retainer extending from the second arm.

9. A ventilation unit comprising:

a housing having a plurality of walls defining an interior space, and an installation system configured to retain the housing to a structure outside the housing, the installation system comprising
- a plurality of primary mounts,
- a temporary mount secured to the housing and configured to at least temporarily couple the housing to the structure, the temporary mount comprising a plurality of retainers configured to pass through at least one slot defined through one or more of the plurality of walls, and
- an attachment bracket configured to be fixed to the structure and configured to engage the temporary mount so that a user installing the housing on the structure can use both hands to install the plurality of primary mounts without having to hold the housing.

10. The ventilation unit of claim 9, wherein the temporary mount comprises an attachment flange configured to secure to the housing in a fixed position, an arm extending from the attachment flange, and the plurality of retainers extend away from the arm on an opposite end of the arm from the attachment flange.

11. The ventilation unit of claim 10, wherein the attachment flange is mounted to an interior surface of the housing such that the attachment flange and the arm are located within the interior space defined by the housing.

12. The ventilation unit of claim 11, wherein an upper end of each retainer extends above a top wall of the housing outside the interior space and engages a portion of the housing to provide a pivot point for each of the retainers as the ventilation system is installed.

13. The ventilation unit of claim 12, wherein the arm is configured to flex and at least one of the plurality of retainers is configured to withdraw into the interior space as the ventilation system is installed on the structure.

14. The ventilation unit of claim 10, wherein the plurality of retainers comprises a first retainer and a second retainer that cooperate to provide variable-height, temporary attachment to the structure, and wherein the first retainer comprises a first bottom edge and a first sloped upper edge and the second retainer comprises a second bottom edge and a second sloped upper edge, and wherein the first bottom edge is located closer to the arm than the second bottom edge.

15. The ventilation unit of claim 14, wherein the first retainer extends to a first width from the arm and the second retainer extends to a second width from the arm, the second width being greater than the first width.

16. The ventilation unit of claim 9, wherein attachment bracket comprises an attachment panel configured to be mounted to the structure, a first mount coupled to a first end of the attachment panel and having a first width, and a second mount coupled to an opposite second end of the attachment panel and having a second width greater than the first width.

17. A ventilation unit comprising:

a housing having at least one wall defining an interior surface and the at least one wall defining an interior space, and a mount coupled to the housing and configured to at least temporarily couple the housing to a structure, wherein the mount comprises a first end fixed to an interior surface of the at least one wall and a second end spaced apart from the first end and movable relative to the housing, and at least one retainer at the second end and configured to pass through a slot defined in the at least one housing wall, the mount configured to be deformed by changing from an undeformed position in which an end of the retainer extends out of the housing a first distance and a deformed position in which the end of the retainer extends out of the housing a second distance less than the first distance.

18. The ventilation unit of claim 17, wherein the mount comprises an attachment flange at the first end and configured to secure to the housing in a fixed position, an arm extending from the attachment flange, and a plurality of retainers that extend away from the arm on the second end of the arm spaced apart from the attachment flange.

19. The ventilation unit of claim 18, wherein the attachment flange and the arm are located within the interior space defined by the housing.

20. The ventilation unit of claim 18, wherein the plurality of retainers comprises a first retainer and a second retainer that cooperate to provide variable-height, attachment to the structure, and wherein the first retainer comprises a first bottom edge and a first sloped upper edge and the second retainer comprises a second bottom edge and a second sloped upper edge, and wherein the first bottom edge is located closer to the arm than the second bottom edge.

* * * * *